US010337297B2

(12) United States Patent
Bruce et al.

(10) Patent No.: US 10,337,297 B2
(45) **Date of Patent: *Jul. 2, 2019**

(54) DOWNHOLE METHOD AND APPARATUS

(71) Applicant: HALLIBURTON MANUFACTURING AND SERVICES LIMITED, London (GB)

(72) Inventors: Stephen Edmund Bruce, Aberdeen (GB); Stephen Kent, Aberdeen (GB); Dominic Patrick McCann, Aberdeen (GB); David Allan Noblett, Aberdeen (GB); David Grant, Aberdeen (GB)

(73) Assignee: HALLIBURTON MANUFACTURING AND SERVICES LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/650,751

(22) Filed: Jul. 14, 2017

(65) Prior Publication Data

US 2017/0314370 A1 Nov. 2, 2017

Related U.S. Application Data

(60) Continuation of application No. 15/166,898, filed on May 27, 2016, now Pat. No. 9,708,893, which is a (Continued)

(30) Foreign Application Priority Data

Nov. 16, 2010 (GB) ..... 1019358.9

(51) Int. Cl.
*E21B 43/04* (2006.01)
*E21B 23/00* (2006.01)
(Continued)

(52) U.S. Cl.
CPC ..... *E21B 43/04* (2013.01); *E21B 23/00* (2013.01); *E21B 33/1277* (2013.01);
(Continued)

(58) Field of Classification Search
CPC .... E21B 33/12; E21B 33/127; E21B 33/1285; E21B 43/103; E21B 43/04; E21B 23/00;
(Continued)

(56) References Cited

U.S. PATENT DOCUMENTS 2,098,484 A * 11/1937 Brundred ..... E21B 33/1277 277/331
2,603,293 A * 7/1952 Lynes ..... E21B 33/134 166/116
(Continued)

FOREIGN PATENT DOCUMENTS

EP 0999342 A2 5/2000
EP 1096104 A1 5/2001
(Continued)

OTHER PUBLICATIONS

European Patent Office, International Search Report and Written Opinion, dated Aug. 9, 2012, 27 pages, Europe.
(Continued)

*Primary Examiner* — Yong-Suk Ro

(57) ABSTRACT

A method of injecting fluid into a formation, comprises exerting a mechanical force on a wall of a bore extending through a formation to modify the permeability of the formation; and injecting fluid into the modified formation. The mechanical force is exerted through inflation of at least one pressure deformable member mounted on a base member with a retaining ring.

7 Claims, 8 Drawing Sheets

Related U.S. Application Data division of application No. 13/884,794, filed as application No. PCT/GB2011/001617 on Nov. 16, 2011, now Pat. No. 9,353,606.

(51) Int. Cl.

| | |
|---|---|
| ***E21B 33/127*** | (2006.01) |
| ***E21B 43/02*** | (2006.01) |
| ***E21B 43/08*** | (2006.01) |
| ***E21B 43/10*** | (2006.01) |
| ***E21B 43/26*** | (2006.01) |
| *E21B 34/06* | (2006.01) |
| *E21B 43/20* | (2006.01) |
| *E21B 43/24* | (2006.01) |
| *E21B 43/25* | (2006.01) |
| *E21B 43/267* | (2006.01) |

(52) U.S. Cl.

CPC ..... *E21B 43/02* (2013.01); *E21B 43/025* (2013.01); *E21B 43/08* (2013.01); *E21B 43/10* (2013.01); *E21B 43/103* (2013.01); *E21B 43/105* (2013.01); *E21B 43/108* (2013.01); *E21B 43/26* (2013.01); *E21B 34/06* (2013.01); *E21B 43/20* (2013.01); *E21B 43/24* (2013.01); *E21B 43/255* (2013.01); *E21B 43/267* (2013.01)

(58) Field of Classification Search

CPC ..... E21B 43/02; E21B 43/025; E21B 43/08; E21B 43/10; E21B 43/105; E21B 43/108; E21B 43/26; E21B 34/06; E21B 43/20; E21B 43/24; E21B 43/225; E21B 43/267

See application file for complete search history.

(56) References Cited

U.S. PATENT DOCUMENTS

| | | | | |
|---|---|---|---|---|
| 2,922,478 | A * | 1/1960 | Maly | E21B 33/127 166/154 |
| 2,969,841 | A | 1/1961 | Thomas | |
| 3,353,599 | A | 11/1967 | Swift | |
| 3,477,506 | A | 11/1969 | Malone | |
| 3,915,227 | A | 10/1975 | Simpson | |
| 4,714,117 | A * | 12/1987 | Dech | E21B 17/00 166/187 |
| 4,834,181 | A | 5/1989 | Uhri et al. | |
| 4,967,846 | A | 11/1990 | Wood | |
| 5,238,067 | A | 8/1993 | Jennings, Jr. | |
| 5,901,789 | A | 5/1999 | Donnelly et al. | |
| 6,026,900 | A | 2/2000 | Keller | |
| 6,315,040 | B1 | 11/2001 | Donnelly | |
| 6,412,565 | B1 | 7/2002 | Castano-Mears | |
| 6,478,092 | B2 | 11/2002 | Voll et al. | |
| 6,543,545 | B1 | 4/2003 | Chatterji et al. | |
| 7,252,142 | B2 * | 8/2007 | Brezinski | E21B 33/12 166/191 |
| 7,422,071 | B2 | 9/2008 | Wilkie et al. | |
| 7,703,520 | B2 * | 4/2010 | Dusterhoft | E21B 43/025 166/278 |
| 7,814,973 | B2 * | 10/2010 | Dusterhoft | E21B 47/01 166/227 |
| 7,841,409 | B2 * | 11/2010 | Gano | E21B 33/1208 166/236 |
| 7,866,383 | B2 * | 1/2011 | Dusterhoft | E21B 43/082 166/227 |
| 2002/0066578 | A1 | 6/2002 | Broome | |
| 2002/0092648 | A1 | 7/2002 | Johnson et al. | |
| 2004/0020660 | A1 | 2/2004 | Johnson et al. | |
| 2004/0055758 | A1 | 3/2004 | Brezinski et al. | |
| 2004/0055760 | A1 * | 3/2004 | Nguyen | E21B 33/1208 166/387 |
| 2005/0016740 | A1 | 1/2005 | Aidaz et al. | |
| 2005/0039917 | A1 | 2/2005 | Hailey, Jr. | |
| 2005/0098324 | A1 | 5/2005 | Gano | |
| 2005/0155773 | A1 | 7/2005 | Wetzel et al. | |
| 2005/0217860 | A1 | 10/2005 | Mack et al. | |
| 2006/0090903 | A1 | 5/2006 | Gano et al. | |
| 2006/0124304 | A1 | 6/2006 | Bloess et al. | |
| 2008/0142219 | A1 | 6/2008 | Steele et al. | |
| 2009/0151942 | A1 | 6/2009 | Bernardi, Jr. | |
| 2009/0166040 | A1 | 7/2009 | Cavender et al. | |
| 2010/0025037 | A1 | 2/2010 | Tibbles | |
| 2010/0038076 | A1 | 2/2010 | Spray et al. | |
| 2010/0071911 | A1 | 3/2010 | Carree | |
| 2010/0132946 | A1 | 6/2010 | Bell et al. | |
| 2010/0155052 | A1 | 6/2010 | Manson | |
| 2011/0036565 | A1 * | 2/2011 | Holderman | E21B 43/08 166/227 |

FOREIGN PATENT DOCUMENTS

| | | | | |
|---|---|---|---|---|
| EP | 1152120 | A2 | 11/2001 | |
| EP | 1840324 | A1 | 10/2007 | |
| GB | 1378596 | | 12/1974 | |
| GB | 2326896 | A | 1/1999 | |
| GB | 2388387 | A | 11/2003 | |
| GB | 2398582 | A | 8/2004 | |
| GB | 2399368 | A | 9/2004 | |
| GB | 2410267 | A | 7/2005 | |
| GB | 2411918 | A | 9/2005 | |
| GB | 2423321 | A | 8/2006 | |
| JP | 2001173600 | | 6/2001 | |
| WO | WO-199925951 | A1 | 5/1999 | |
| WO | WO-199945236 | A1 | 9/1999 | |
| WO | WO-200001926 | A1 | 1/2000 | |
| WO | WO 0058601 | * | 10/2000 | E21B 33/12 |
| WO | WO-2003100211 | A1 | 12/2003 | |
| WO | WO-2007017836 | A1 | 2/2007 | |
| WO | WO-2009001069 | A2 | 12/2008 | |
| WO | WO-2009001073 | A2 | 12/2008 | |
| WO | WO-2009018015 | A1 | 2/2009 | |
| WO | WO-2010083166 | A2 | 7/2010 | |
| WO | WO-2012066290 | A2 | 5/2012 | |

OTHER PUBLICATIONS

M.V. Pyatakhin, Super Well With Stressed Screen, 2006, 12 pages, 23rd World Gas Conference, Scientific-Research Institute of Natural Gases and Gas Technologies, Amsterdam.

United Kingdom Intellectual Property Office, Search Examination Report, dated Jun. 18, 2018, 6 pages, United Kingdom.

* cited by examiner 58
60

50
62
52
56
68
70
54
60
66
64
58

DOWNHOLE METHOD AND APPARATUS

CROSS-REFERENCE TO RELATED APPLICATIONS

The present application is a Continuation of U.S. patent application Ser. No. 15/166,898 filed May 27, 2016, which is a Divisional of U.S. patent application Ser. No. 13/884,794, filed Jun. 3, 2013 (now U.S. Pat. No. 9,353,606), which is a National Stage Application of International Application No. PCT/GB2011/001617, filed on Nov. 16, 2011, which claims priority to GB Patent Application No. 1019358.9, filed Nov. 16, 2010. The disclosure of each of which is incorporated herein by reference in its entirety.

FIELD OF THE INVENTION

This invention relates to methods and apparatus for use in conditioning drilled bores. Aspects of the invention relate to applying forces to a bore wall to control or influence the rate of flow of fluid through the bore wall.

BACKGROUND OF THE INVENTION

WO 2009/001073 and WO 2009/001069, the disclosures of which are incorporated herein by reference in their entirety, describe methods and apparatus for use in conditioning bores used to access hydrocarbon or water-bearing formations. For example, the apparatus described therein may be utilised to maintain the porosity of a bore wall as the pore pressure of the rock surrounding the bore wall falls.

The present invention is described primarily herein with reference to extraction of hydrocarbons, but also has application in other areas, such as water extraction and fluid disposal.

SUMMARY OF THE INVENTION

According to the present invention there is provided a method of injecting fluid into a formation, the method comprising:

exerting a mechanical force on a wall of a bore extending through a formation to modify the permeability of the formation; and injecting fluid into the modified formation.

The mechanical force may be exerted through inflation of at least one pressure deformable member mounted on a base member. The base member may be a base pipe. The pressure deformable member may be a hollow or tubular member mounted externally of the base pipe. A plurality of pressure deformable members may be provided. The pressure deformable member may be non-concentric with the base pipe, that is the member and the base pipe do not share a common centre and the base pipe is not mounted within the pressure deformable member.

The mechanical force may be selected to modify rock strength.

The mechanical force may be utilised to increase or decrease the permeability of the formation. For example, if a low permeability rock is subject to stress above the failure strength of the rock an increase in permeability will initially occur as a result of brittle fracturing. Alternatively, a higher permeability rock may be subject to a decrease in permeability if subject to stress. The method may comprise increasing the permeability of one section of formation and decreasing the permeability of another section. Thus, an operator may modify the permeability profile of a bore to facilitate direction of injection fluid. Of course this aspect of the method may also be utilised in operations other than fluid injection, for example in modifying the permeability profile of a bore for production purposes.

A mechanical force may be maintained on the formation as the fluid is injected, which force may remain constant over time or which force may vary over time. An applied force thus continues to support the formation and maintain the formation in a desired state, which state may vary over the working life of the formation.

The injected fluid may take any appropriate form or include any appropriate material, for example production water, gas, steam, or a treatment fluid or proppant. Thus the method may have utility in an injection process for enhancing recovery of hydrocarbons from the formation. The injection fluid may be utilised to maintain pressure in the formation, or to displace hydrocarbons to an upper portion of the formation.

The method may form part of a fracking operation. For example, the method may be utilised to provide initial fracturing of the formation around and adjacent the bore wall, the fluid then being injected to fracture the formation beyond the bore wall. The method may comprise maintaining a force on the bore wall during or subsequent to the fluid injection step.

The invention may also have utility in gas storage, when an underground formation is utilised as a storage reservoir for gas produced elsewhere. In such a situation gas from other geographical regions may be injected into the formation during periods of low local demand and withdrawn from the formation in periods of high demand. The invention may comprise maintaining a predetermined force on the bore wall as gas is injected into the formation and further maintaining a predetermined force on the bore wall as gas passes from the formation, which processes or cycles may be repeated on numerous occasions over the life of the facility. The invention may thus facilitate maintenance of the formation in a desired state, and delay or prevent deterioration or collapse of the formation. The method may also have utility in the creation of the storage formation, which may involve water or brine being injected into a formation, for example a salt formation, to remove soluble material and create a porous structure, and the water then being removed. A force may be maintained on the bore wall during some or all of these steps.

The invention may also have utility in long term gas storage, for example in the capture and storage of carbon dioxide or other fluids. In this situation the method may be utilised to increase or maintain formation permeability to facilitate injection of the gas into the formation. Subsequently the method may be utilised to facilitate retention of the gas in the formation, or in a selected formation section, for example by applying a force to the bore wall to decrease formation permeability.

According to the present invention there is provided a gravel packing method comprising locating gravel in an annulus between a bore wall and an apparatus comprising at least one pressure deformable member and inflating the member to stress the gravel.

The inflation of the member may also stress the bore wall.

The member may be mounted externally of a base member, such as a base pipe, and the apparatus may take the form of a completion. One or more pressure deformable members may be provided and the apparatus may be arranged to provide a substantially circumferential or cylindrical outer compression face to apply a compression force to a gravel-filled annulus between the apparatus and the bore wall.

The presence of the deformable member in the apparatus allows the gravel to be stressed without the requirement to run in an additional or separate expansion apparatus. The pressure deformable member may communicate with an appropriate source of fluid, for example the bore of a base pipe. The communication may be via a one way valve, such that the member may be inflated by pressurising the base pipe, for example by use of surface pumps.

The method may be utilised to assure the quality and consistency of the gravel pack. The pressure utilised to deform the member, and the form of the member, may be selected to ensure that the gravel is packed to a consistent level, irrespective of initial inconsistencies in gravel density or bore wall form.

According to the present invention there is provided a method of conditioning a bore comprising exerting a mechanical force to a bore wall to fracture the rock adjacent the bore wall.

The mechanical force may be exerted through inflation of at least one non-concentric pressure deformable member.

This aspect of the invention may be useful for a number of reasons, for example to increase the permeability of the bore wall, to facilitate injection of fluid into the rock or to facilitate production of fluid from the rock.

According to the present invention there is provided a method of conditioning a bore comprising reducing the strength of the rock adjacent the bore wall.

According to the present invention there is provided a method of conditioning a bore, the method comprising exerting a force to a bore wall to reduce the permeability of the of the rock adjacent the bore wall.

This aspect of the invention may be useful to reduce fluid production from a formation, for example to reduce water production. Alternatively, the method may be used to balance production of oil or gas from a bore section, for example slowing production of hydrocarbons from the heel of a horizontal well section. In other situations the invention may be utilised to reduce the permeability of a low pressure section, to reduce or minimise losses into the section.

According to the present invention there is provided a method of conditioning a bore, the method comprising exerting a force on a bore wall to reduce production of particulates.

The method has particular utility in the inhibition of sand production.

The force may be exerted through inflation of at least one non-concentric pressure deformable member, that is a member which is mounted on a base member, such as a base pipe, and is not concentric with the base member, that is the members do not share a common centre and the base member is not located within the pressure deformable member.

According to the present invention there is provided a method of producing fluid from a bore, the method comprising:

running an apparatus comprising a sand control element mounted on at least one pressure deformable chamber into a lined bore;

inflating the chamber to increase the diameter described by the element; and producing fluid through the element.

The diameter of the sand control element may be increased to bring the element adjacent to or into contact with an inner surface of the bore lining, which may be perforated casing or liner. The use of an inflatable member facilitates expansion of the element to match the inner diameter of the bore lining.

The inflation of the chamber may be maintained to maintain the expanded diameter of the element.

This aspect of the invention may be useful in controlling sand production, allowing a sand screen to be run through existing tubing and expanded into position to minimise or reduce sand production.

The chamber may be mounted on a base member, such as a base pipe. The chamber may be non-concentrically mounted on the base pipe, that is the chamber and the base pipe do not share a common centre.

The pressure deformable chamber may take any appropriate form and may be inflated by any appropriate method. Inflating fluid may be supplied to the chamber from an appropriate fluid source. The chamber may communicate with the interior of a supporting base pipe via a valve, allowing fluid pressure to be communicated from the base pipe to the chamber, the valve retaining the fluid in the chamber when pressure is bled off from the base pipe.

According to the present invention there is provided a method comprising:

running an apparatus comprising a sand control element mounted on at least one pressure deformable chamber through a lined bore section of a first diameter and into a bore section of a larger second diameter;

inflating the chamber to increase the diameter described by the element; and producing fluid through the element.

The chamber may be inflated to increase the diameter described by the element to a diameter larger than the first diameter. The chamber may be inflated to increase the diameter described by the element to the second diameter.

According to the present invention there is provided a method of conditioning a bore comprising: providing a member having multiple elements for controlling the outer diameter of the member; locating a member in a bore; and controlling the elements to increase the diameter defined by the member to apply a force to the bore wall.

According to the present invention there is provided a method of conditioning a bore comprising: providing a member having multiple elements for controlling the outer diameter of the member; locating a member in a bore; increasing the diameter defined by the member to apply a force to the bore wall; and then controlling the elements to decrease the outer diameter of the member to control the force applied to the wall by the member.

By controlling the force applied to the wall by the member it may be possible to control the permeability of the bore wall.

The elements may comprise pressure deformable chambers and the diameter of the member may be controlled by inflating and deflating the chambers. The chambers may be mounted on a base pipe. The chambers may support a sand control element.

The elements may extend axially or circumferentially of the member.

The elements may be controlled to provide a uniform increase or reduction in outer diameter. Alternatively, the elements may be controlled to increase or reduce the outer diameter of one portion of the member at a different rate to another portion of the member. For example, the member may be a tubing string comprising multiple tubing sections or joints, and the diameter of one tubing joint may be increased or decreased at a different rate than another tubing joint. Thus, the apparatus may be utilised to apply different forces to different sections of the bore, which may coincide with different rock layers. Alternatively, or in addition, the elements may be controlled to increase or reduce the outer diameter of one portion of the circumference of the member at a different rate to another portion of the circumference of the member. Thus, for example, the width of the member on one transverse axis may be increased or reduced at a different rate to the width of the member on a different transverse axis.

The force applied to the bore wall by the member may be constant or may vary over time. The applied force may be predetermined based on surveys or other studies of the bore or rock and on the predicted or modelled behaviour of the rock during, for example, fluid injection or production. Alternatively or in addition, the force applied may be determined based on measured parameters. The force applied to the bore wall by the member may vary along and around the axis of the member. The force applied at any point may be selected based on one or more of geomechanical stress, modelling of the bore such as stress modelling, or in accordance with variations in the stress field, pore pressure or other formation properties such as rock strength.

According to the present invention there is provided a method of conditioning a bore comprising locating a member in an inclined or horizontal bore having upper, lower and side wall portions, and operating the member to apply forces to the wall portions, wherein a larger force is applied to the upper and lower bore wall portions.

According to the present invention there is provided a method of conditioning a bore comprising locating a member in an inclined or horizontal bore having upper, lower and side wall portions, operating the member to apply forces to the wall portions, and varying the forces applied to the respective wall portions to maintain a desired bore form.

Thus, these aspects may be used to facilitate maintaining the desired form of an inclined or horizontal bore, particularly as material is removed from a formation and the resistance of the formation to crushing is reduced, such that the upper and lower faces of the member may have to support overburden to prevent at least partial collapse of the bore.

According to the present invention there is provided a drilling method comprising running an apparatus comprising at least one pressure deformable chamber into a drilled bore and inflating the chamber to engage the bore wall, and continuing to drill the bore beyond the chamber.

The chamber may be non-concentrically mounted on a base pipe.

The chamber may serve to stabilize an unstable or swelling formation, to reduce or prevent fluid losses into a low pressure formation, or to stem the flow of fluid into a bore from a high pressure formation.

The apparatus may be mounted on the drill string or may be run in separately of the drill string.

The apparatus may be removed from the bore once a situation has been stabilized or other measures have been put in place. The removal of the apparatus from the bore may be facilitated by deflating the pressure deformable chamber, permitting ambient pressure in the bore to flatten the chambers, or by utilizing elastic-walled chambers. Alternatively, the apparatus may remain in the bore. In other embodiments, parts of the apparatus may remain in the bore while other parts of the apparatus are retrieved. For example, the apparatus may carry an expandable or extendable fluid impermeable element, and inflation of the fluid deformable chambers may locate the element against the bore wall. The fluid impermeable element may be configured to retain the larger diameter when the chambers are deflated, or the element may be held in place by differential pressure. The element may thus serve to prevent or minimise losses into a low pressure formation or may be utilized to minimise problems due to differential sticking.

According to the present invention there is provided a downhole apparatus comprising a base pipe, at least one pressure deformable chamber mounted externally thereon, the chamber configured for expansion to exert a force on a wall of a bore, and a fluid conduit mounted externally of the base pipe and configured for supplying fluid to the chamber.

Thus, in this aspect, the pressure deformable chamber is inflated without requiring the presence of an inner string to convey fluid pressure to the chamber.

Other aspects of the invention may also operate without requiring the presence of an inner string.

The fluid conduit may be configured to extend to surface.

The chamber may define the fluid conduit.

According to the present invention there is provided a method of exerting a force on a wall of a bore, the method comprising locating at least one pressure deformable chamber in an annulus between a base pipe and a bore wall and inflating the chamber with fluid from said annulus.

According to the present invention there is provided a method of exerting a force on a wall of a bore, the method comprising locating at least one pressure deformable chamber in an annulus between a base pipe and a bore wall and inflating the chamber with fluid from a downhole source.

The downhole source may be one or more of said annulus, a pressurised vessel, such as a gas bottle, a fluid generating source, such as a chemically-activated gas generating device, or a high pressure formation.

A high pressure formation may be isolated by packers and communicate high pressure fluid to the chamber via a control line or the like.

According to the present invention there is provided a downhole apparatus comprising a base pipe, at least one pressure deformable chamber mounted thereon, and a remotely operable valve arrangement for controlling fluid access to the chamber.

The valve may be configured to open only when actuated or instructed.

A plurality of chambers may be provided and fluid access to the chambers may be controlled by respective valve arrangements facilitating controlled inflation of the chambers.

According to the present invention there is provided a downhole apparatus comprising a base pipe, and at least one pressure deformable chamber mounted externally thereon, the chamber configured for expansion to exert a force on a wall of a bore and whereby a first portion of the chamber expands prior to a second portion of the chamber.

This aspect of the invention may be utilised to expand the chamber in a predetermined manner, for example expanding the chamber from one end, or expanding a first portion of the chamber to actuate or form a packer before expanding the remaining portion of the chamber.

The chamber may have portions having different physical properties, for example different wall thicknesses or different wall configurations, or may be formed from different materials. Alternatively, or in addition, chamber may comprise discrete cells which inflate in sequence, for example being connected by valves or burst discs, or connected to a fluid source via individually controlled valves.

According to an aspect of the invention there is provided a method of conditioning a bore wall comprising: providing a member including pressure deformable chambers; locating the member in a bore; and inflating the chambers with settable material.

In one embodiment of this aspect of the invention the settable material may maintain the inflated form of the chamber without the continued application of internal fluid pressure.

The settable material may set or cure to provide a solid material of predetermined strength or crush resistance. The set material may thus be utilised to control the strength or crush resistance of the chambers.

The set material may be flexible or compliant or may be substantially rigid and inflexible.

The settable material may be supplied to the chambers at a pressure sufficient to inflate the chambers to a desired degree. Alternatively or in addition, the settable material may be selected to increase in volume in the chambers, for example the material may tend to expand as it cures or sets. This property may be utilised to increase the pressure within the chambers beyond the maximum fluid supply pressure.

The settable material may be a multipart material, for example a two-part material which expands or sets on the materials being mixed or otherwise brought into contact. In one embodiment one part of the material may be provided in the chambers and another part of the material may be provided in the inflating material.

According to the present invention there is provided a downhole apparatus comprising a sand control element having a first edge and a second edge, the edges overlapping and whereby the element is configurable in a smaller diameter configuration and a larger diameter configuration.

The sand control element may be mounted over an apparatus comprising at least one pressure deformable chamber, whereby inflation of the chamber increases the diameter described by the element.

The apparatus may have a longitudinal axis and the edges of the element may be inclined to the longitudinal axis. Alternatively, or in addition, the circumferential location of the edges of the element may vary along the length of the apparatus. These features assist in avoiding the situation where the overlapping edges or a particular edge is located in a situation in a bore, such as a pinch point, which resists relative movement of the edges. For example, if the overlap is located on the low side of a horizontal bore the weight of the apparatus may make relative movement of the edges more difficult. However, if the location of the edges varies along the length of the apparatus the overlap may only be on the low side of the bore over a limited section. This assists in avoiding a potential disadvantage of using a single sand control element having a relatively large initial overlap, rather than the plurality of smaller overlaps present in the conventional sand screen configuration featuring a plurality of overlapping filter elements.

This aspect of the invention may also be utilised in apparatus comprising multiple sand control elements, where adjacent inclined edges of elements overlap.

The sand control element may be mechanically fixed or secured to a support member, for example by welding or by means of fasteners such as bolts. Alternatively, the sand control element may not be fixed to the support, but be floating. That is, a degree of circumferential movement may be permitted between the support and the element.

A drainage layer may be provided below the sand control element.

The sand control element may be woven and mounted on a support having a longitudinal axis, wherein the woven element has a warp and a weft arranged to be inclined to the longitudinal axis of the support. The inclination of the warp and weft relative to the longitudinal axis of the support, which may involve the orientation of the axis with the element bias, provides greater flexibility and facilitates extension or expansion of the element.

According to the present invention there is provided a downhole apparatus comprising a base pipe, at least one pressure deformable chamber mounted externally thereon, the chamber configured for expansion to exert a force on a wall of a bore, and a bridging member operatively associated with the chamber and configured to exert a force on the bore wall between spaced portions of the chamber.

As the at least one pressure deformable chamber is expanded there may be spaces or gaps between outer portions of the chamber. The bridging member may extend across these spaces or gaps and serve to ensure that an appropriate force is exerted on the bore wall between the outer portions of the chamber.

The bridging member may take any appropriate form, for example a plurality of axially extending bridging members may be provided and extend between axially extending pressure deformable chambers. The bridging members may serve to ensure that the apparatus maintains a substantially cylindrical form as the chamber is expanded. The bridging members may define segments of a cylinder The chamber and bridging member may be configured to permit fluid to pass radially therethrough, for example the bridging member may be apertured.

The bridging member may serve as a drainage member and may be located beneath a sand screen, serving to maintain the sandscreen in a substantially cylindrical form.

According to the present invention there is provided a downhole apparatus comprising at least one pressure deformable chamber comprising a metallic member having an end closed by a tapered or rounded weld.

The use of a tapered or rounded weld reduces the build-up of stresses at the end of the chamber during inflation of the chamber.

According to the present invention there is provided a downhole apparatus comprising a base pipe, a plurality of axially extending pressure deformable members mounted around the base pipe and at least one circumferential retaining ring located externally of the members.

The deformable members may be initially located on the base pipe in a flattened or deflated configuration and the retaining ring located over the flattened members. A plurality of rings may be provided, for example a ring may be provided at each end of a pipe joint.

According to the present invention there is provided a method of fixing a hollow member to a base pipe, the method comprising providing a hollow member with a wall defining first and second apertures, welding the member to a base pipe at the first aperture and then closing the second aperture.

The provision of the apertures allows an operator to use the second aperture to gain access to the first aperture and weld the member to the base pipe at the first aperture. The welding operation may create a fluid-tight seal at the first aperture, or a separate operation may be carried out to seal the aperture. The second aperture may be closed, to seal the hollow member, by welding a patch over the second aperture.

According to the present invention there is provided a downhole apparatus comprising a base pipe and a plurality of deformable pressure chambers mounted thereon, the chambers being provided in multiple layers.

A first layer of chambers may be provided on a first circumference and a second layer of chambers may be provided on a larger second circumference.

This aspect of the invention facilitates provision of an apparatus providing a high degree of expansion. The adjacent layers of chambers may nest or may be radially aligned.

The pressure deformable chambers utilised in the various embodiments the present invention may be formed by any appropriate method. The chamber may be formed by utilising a substantially cylindrical pipe and then reforming the pipe to a flattened or other form, ready for inflation. This reforming may be achieved by a number of methods: the original pipe may be pulled through a set of rollers to progressively form the desired shape; the original pipe may be drawn through a set of forming dies to progressively form the shape; the original pipe may be pressed in a mechanical forming press to form or progressively form the shape; the original pipe may be presented into a pressurised chamber with shaped forms, and water pressure injected at high pressure to form the shape required. Alternatively, the chamber could be initially formed in the flattened or lower profile form, and may be formed from flat strip which is formed into the desired shape and welded to the base pipe or welded to form a fluid tight chamber.

It will be apparent to those of skill in the art that the features of the various aspects of the present invention may be combined and also that the features of the aspects described above, and the features of the embodiments described below, may provide utility in isolation or in different combinations to those described herein and may form further aspects of the invention.

BRIEF DESCRIPTION OF THE DRAWINGS

These and other aspects of the invention will now be described, by way of example only, with reference to the accompanying drawings, in which.

DETAILED DESCRIPTION OF THE DRAWINGS

Figure 1:
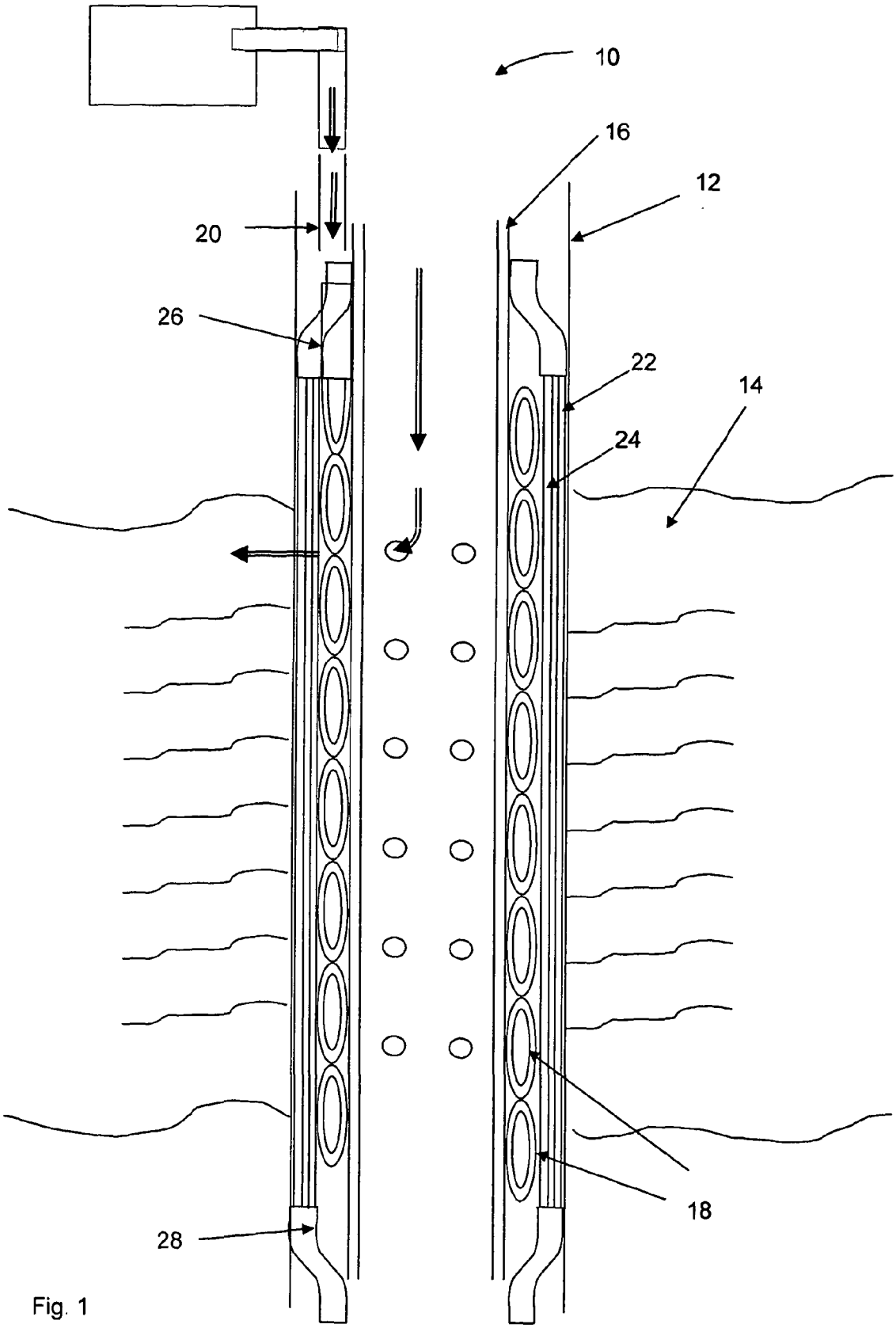
FIG. 1 is a schematic sectional view of a fluid injection operation in accordance with an embodiment of the present invention.

Reference is first made to FIG. 1 of the drawings, which illustrates apparatus 10 in accordance with an embodiment of the invention. The apparatus is illustrated in a deployed, installed configuration, located in a bore 12 intersecting a formation 14. The apparatus 10 comprises a base tube 16 forming part of a tubing string, such as completion, which provides communication to surface. Mounted on a portion of the base tube is a plurality of hollow members 18 which define fluid pressure-deformable chambers. The wall of the base tube 16 defines flow ports 20 which allow fluid to flow between the formation and the interior of the tube 16, and then to surface. Valves, such as inflow control devices (ICDs), may be provided to control the flow of fluid through the ports 20.

A sand control element 22 in the form of a sand screen is wrapped around the members 18 and a drainage layer 24 is provided beneath the element 22. Packing elements 26, 28 are also provided around the base tube 16 and the ends of the members 18 at the upper and lower ends of the sand screen 22.

The hollow members 18 are mounted side-by-side on the base tube 16. The members 18 are formed by cold rolling flat plate but may also be formed of metal tubes which have been flattened. The members 18 may extend substantially axially of the tube 16, but in this embodiment are in a helical configuration. The members 18 are connected to a source of pressurized fluid on surface via appropriate control lines 20, which source may be utilized to inflate the members 18 such that the inflated members 18 collectively define a larger outer diameter, as illustrated in FIG. 1. In other embodiments a pressurized activation chamber may form part of the apparatus 10 and be run into bore, as described below with reference to FIG. 2. In any event, the apparatus 10 is configured such that inflation of the members 18 brings the sand screen 22 and the packing members 26, 28 into contact with the bore wall. The inflation pressure, and the construction and configuration of the members 18, is also selected to exert and maintain a predetermined radial force on the bore wall, as will be described below. The members 18 may be made in accordance with the teaching of WO 2009/001073 and WO 2009/001069, the disclosures of which are incorporated herein by reference in their entirety, or in accordance with the other aspects or embodiments of the present invention, as described herein.

In use, the apparatus 10, with the members 18 in the initial flattened configuration, is run into the bore 12 on the tubing string and located at an appropriate point in the bore. In FIG. 1, the apparatus 10 has been positioned with the portion of the tube 16 carrying the members 18 straddling a formation 14 which is intersected by the bore 12.

Fluid is applied from surface and pressure increased to inflate the members 18 and push the sand screen 22 and the packing elements 26, 28 into contact with the bore wall, as illustrated in FIG. 1. As described below, the pressure of the fluid may be controlled to provide a predetermined load or force on the bore wall. The load or force provided by the members 18 may be substantially constant, or may be varied over time.

If the formation is formed of relatively low permeability rock the members 18 may be inflated using sufficiently high pressure fluid to subject the rock adjacent the bore wall to a stress above the failure strength of the rock. This results in brittle fracturing of the rock, and increases the permeability of the rock. An operator may then pump fluid at high pressure through the string to further fracture the rock. The fluid may contain chemicals or treatment agents, such as stabilizing agents or proppants. Alternatively, the operator may inject fluid into the formation to, for example, maintain or increase production at another part of the formation.

The operator may subsequently reduce the pressure of the fluid in the tubing string and permit fluid to flow from the formation 14 into the string and on to surface.

During injection of fluid into the formation or production of fluid from the formation 14 the pressure within the members 18 may be varied to change the force applied to the bore wall by the apparatus 10 to maximize the bore wall permeability and thus maintan the injection or production rates as high as possible.

Alternatively, or in addition, the pressure within the members 18 may be selected or varied to decrease the permeability of the rock, and thus decrease or minimize the flow of fluid into or from the formation 14. This may be useful if the formation 14 is at relatively low pressure and production fluid from higher pressure formations, or treatment or other fluid intended for other formations or intended to remain in the bore to provide a pressure barrier, is flowing into the formation 14. Also, if it is desired to reduce production from the formation, for example if the formation 14 is producing too much water, the permeability of the rock may be reduced. This method of decreasing the permeability of the rock forms a separate aspect of the present invention.

In other embodiments the force created by the members 18 may be selected to control the production of particulates from the formation 14. Further embodiments may utilize an inflation fluid which solidifies after a predetermined period. This may limit the ability of the operator to control the force applied by the members 18 after initial inflation but may avoid any risk of the members 18 deflating.

A completion or other tubing string may be provided with any number of apparatus 10, and each apparatus may be under common or individual control. The individual apparatus may be inflated simultaneously or separately. Each apparatus may exert the same force on the bore wall or may exert an individually determined force. The force exerted by each apparatus may be constant or may vary over time.

Figures 2, 3:
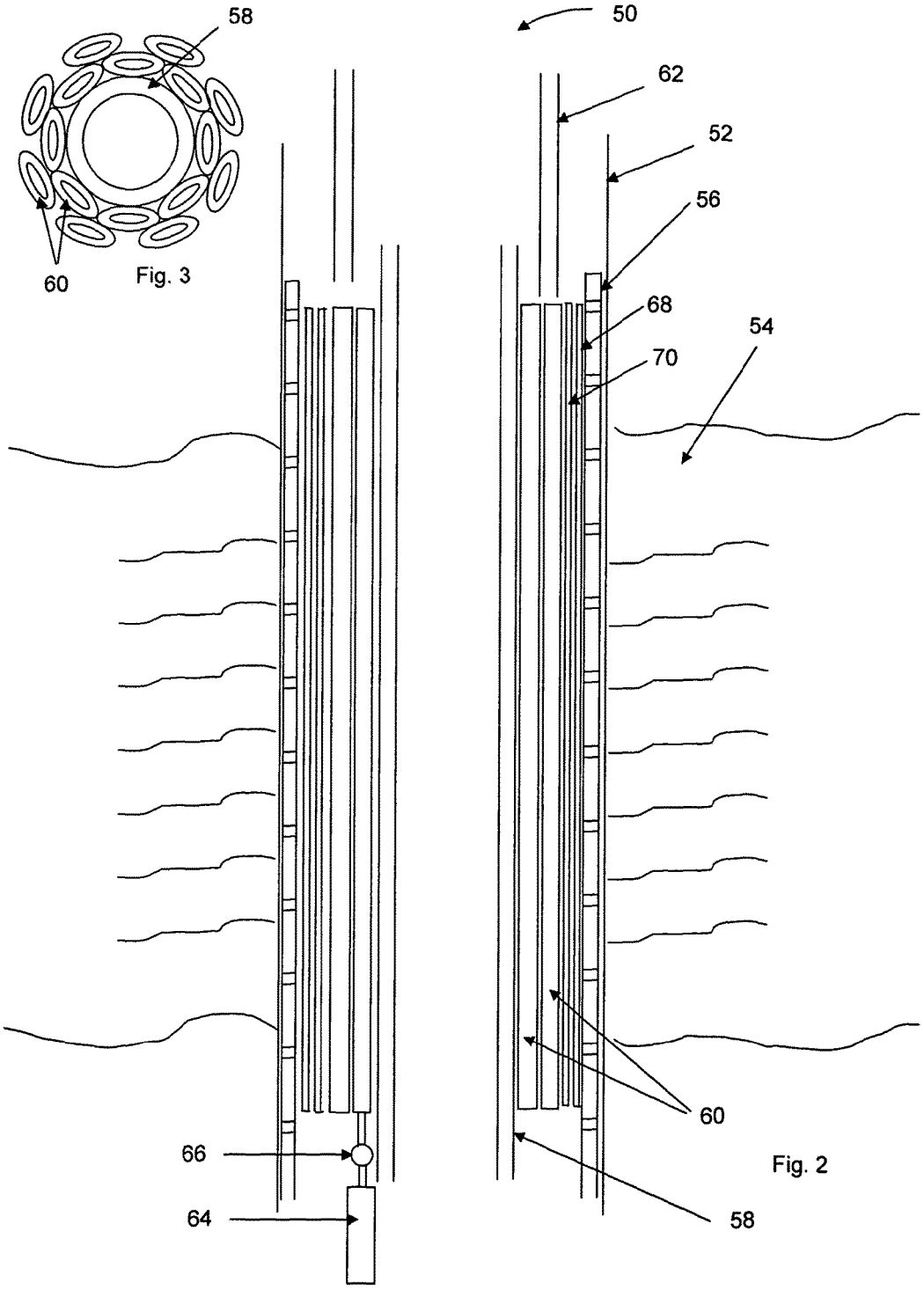
FIG. 2 is a schematic sectional view of a through tubing sand control operation in accordance with another embodiment of the present invention.
FIG. 3 is a sectional view of part of the apparatus of FIG. 2.

FIG. 2 of the drawings illustrates a through-tubing sand control apparatus 50 in accordance with an embodiment of the present invention. The apparatus 50 is illustrated in a deployed extended configuration within a bore 52 intersecting a formation 54, the bore having previously been lined with a perforated liner 56. The apparatus comprises a base pipe 58 around which are mounted two layers of inflatable hollow members 60. The members 60 are initially provided on the pipe 58 in a flattened configuration and describe a relatively small external diameter, allowing the apparatus 50 to be run into a bore through existing tubing 62. The members 60 are coupled to an appropriate source of pressurized fluid, in this example a plurality of gas bottles or pressurized nitrogen chambers 64 mounted on the distal end of the base pipe 58. The flow of fluid from the bottles 64 to the members 60 is controlled by a valve 66 which may be activated by any appropriate mechanism, such as by RFID tags which are dropped or pumped from surface.

As is apparent from FIG. 3, the members 60 extend axially of the base pipe 58, and are nested to provide essentially complete circumferential support for a sand screen 68 and a drainage layer 70.

In use, the apparatus 50 will typically be deployed only if sand production from the formation 54 through the perforated liner 56 reaches an unacceptable level. The apparatus 50 is then run into the bore 52, through the existing tubing 62, to locate the apparatus 50 adjacent the formation 54. The valve 66 is then opened to allow fluid to flow from the bottles 64 to inflate the members 60. The diameter described by the members 60 increases significantly and brings the sand screen 68 into contact with the inner surface of the liner 56. Thus, fluid from the formation 54 now has to pass through the sand screen 68 before entering the bore 52, such that the flow of particulates into the bore 52 will be substantially reduced.

Figure 4:
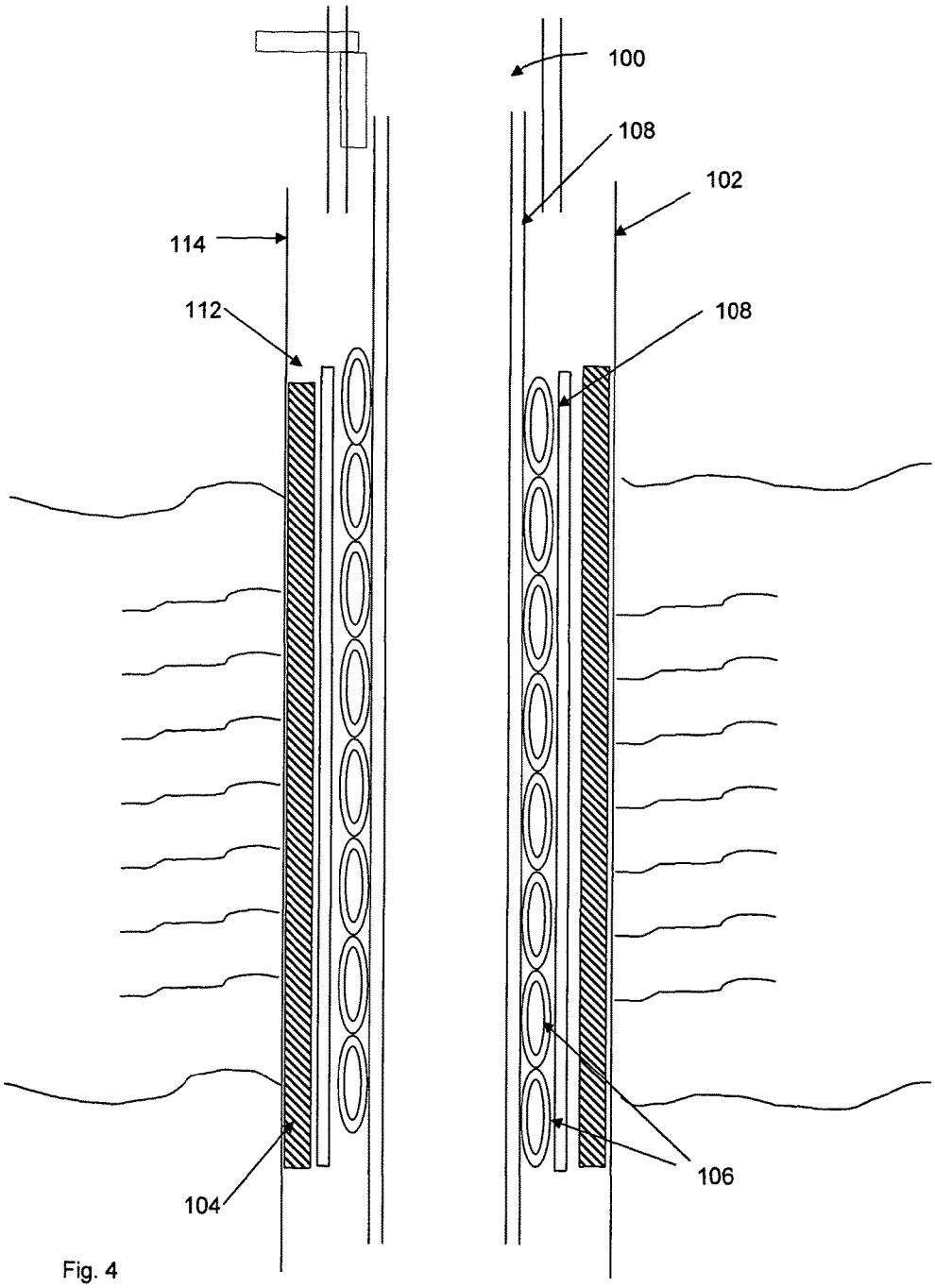
FIG. 4 is a schematic sectional view of a gravel packing operation in accordance with a further embodiment of the present invention.

FIG. 4 of the drawings illustrates apparatus 100 in accordance with an embodiment of the invention deployed within a bore 102 including a gravel pack 104. As with the embodiments described above, the apparatus includes a number of pressure deformable members 106 mounted around a base pipe 108 and supporting a sand screen 110. The sand screen 110 may take any suitable form, and may be a woven element, which may be expandable. The pressure deformable members 106 communicate with the interior of the base pipe 108 via one-way valves, such that the members 106 may be inflated simply by pressurising the interior of the base pipe 108.

The apparatus 100 is run into the bore in an initial smaller diameter configuration. The gravel pack 104 is then circulated into the annulus 112 between the sand screen 110 and the bore wall 114. Following this, the members 106 are inflated and the gravel 104 is compressed and stressed. Furthermore, the wall of the bore may also be stressed. The members 106 are provided with a degree of excess expansion, that is the members 106 will extend to compress the gravel 104, and the bore wall, even if a section of annulus 112 has not been fully packed, or the bore wall 114 is irregular. Thus, the apparatus 100 is compliant and provides an assured degree of compression to the gravel 104. This assists in providing a consistent gravel pack providing consistent sand retention and flow characteristics.

Once the well is producing, formation fluid will flow from the surrounding formation, through the gravel 104 and sand screen 110, around the members 106 and into the base pipe 108, before flowing to surface. The gravel pack 104 serves to stabilise the well bore wall and prevents or limits the migration of fines from the bore wall, or fines entrained with the formation fluid, into the pipe 108. The sand screen 110 will also serve to prevent particulates from passing into the pipe 108, and will also serve to retain the gravel 104.

Figure 5:
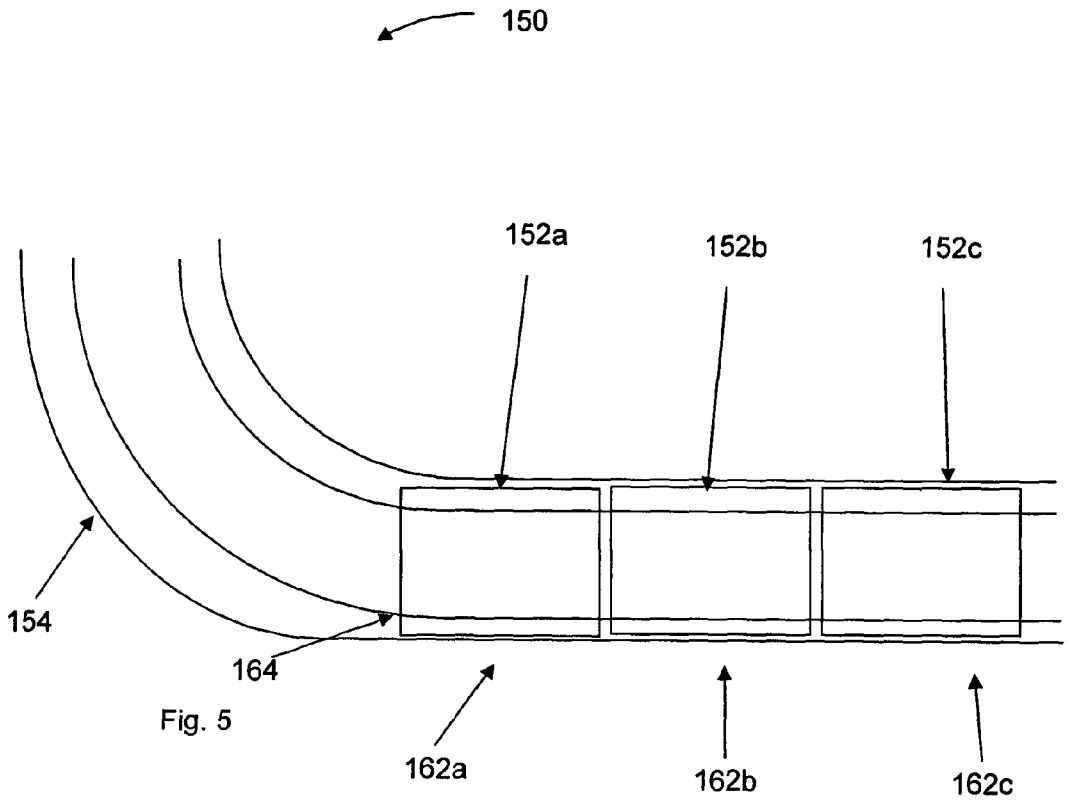
FIG. 5 is a sectional view of a completion including apparatus in accordance with an embodiment of the present invention.
Figure 6:
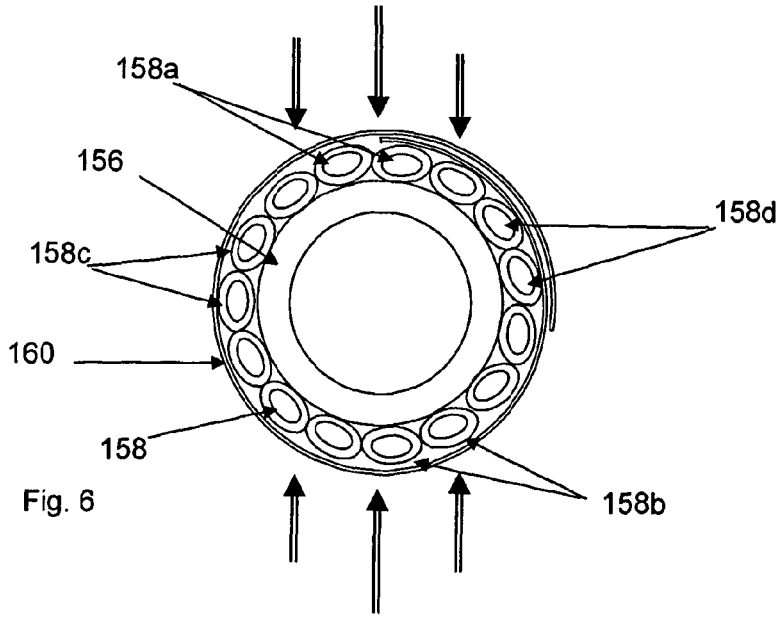
FIG. 6 is a sectional view of part of the apparatus of FIG. 5.

FIGS. 5 and 6 of the drawings illustrates a completion 150 provided with apparatus 152*a,b,c* in accordance with an embodiment of the invention. The completion 150 is provided in a horizontal bore section 154. Each apparatus 152*a,b,c* comprises a base pipe 156, pressure deformable members 158 and a sand screen 160.

In use, the completion 150 is assembled such that, when the completion is run into the bore, each apparatus 152*a,b,c* is positioned adjacent a selected formation or production zone 162*a,b,c*. The members 158 are then inflated such that the sand screens 160 contact the opposing bore wall and exert an appropriate force on the bore wall to, for example, increase the rock permeability. The forces applied on the bore wall may be varied over time to compensate for reductions in rock pore pressure, as discussed in more detail in WO 2009/001073 and WO 2009/001069.

Each apparatus 152*a,b,c* may create a different bore wall stress. For example, the apparatus 152*a* at the heel 164 may exert a higher force selected to reduce fluid production from an elastic high porosity formation, and minimize the risk of excess water production. If the risk of excess water production recedes, the apparatus 152*a* may be deflated and the bore wall stress reduced, increasing formation porosity.

Furthermore, the inflation/deflation of fluid supplied to individual members 158 may be individually controlled, for example the members 158*a,b* on the upper and lower faces of an apparatus 152 may be deflated at a different rate to the members 158*c,d* on the sides of the apparatus.

Figure 7:
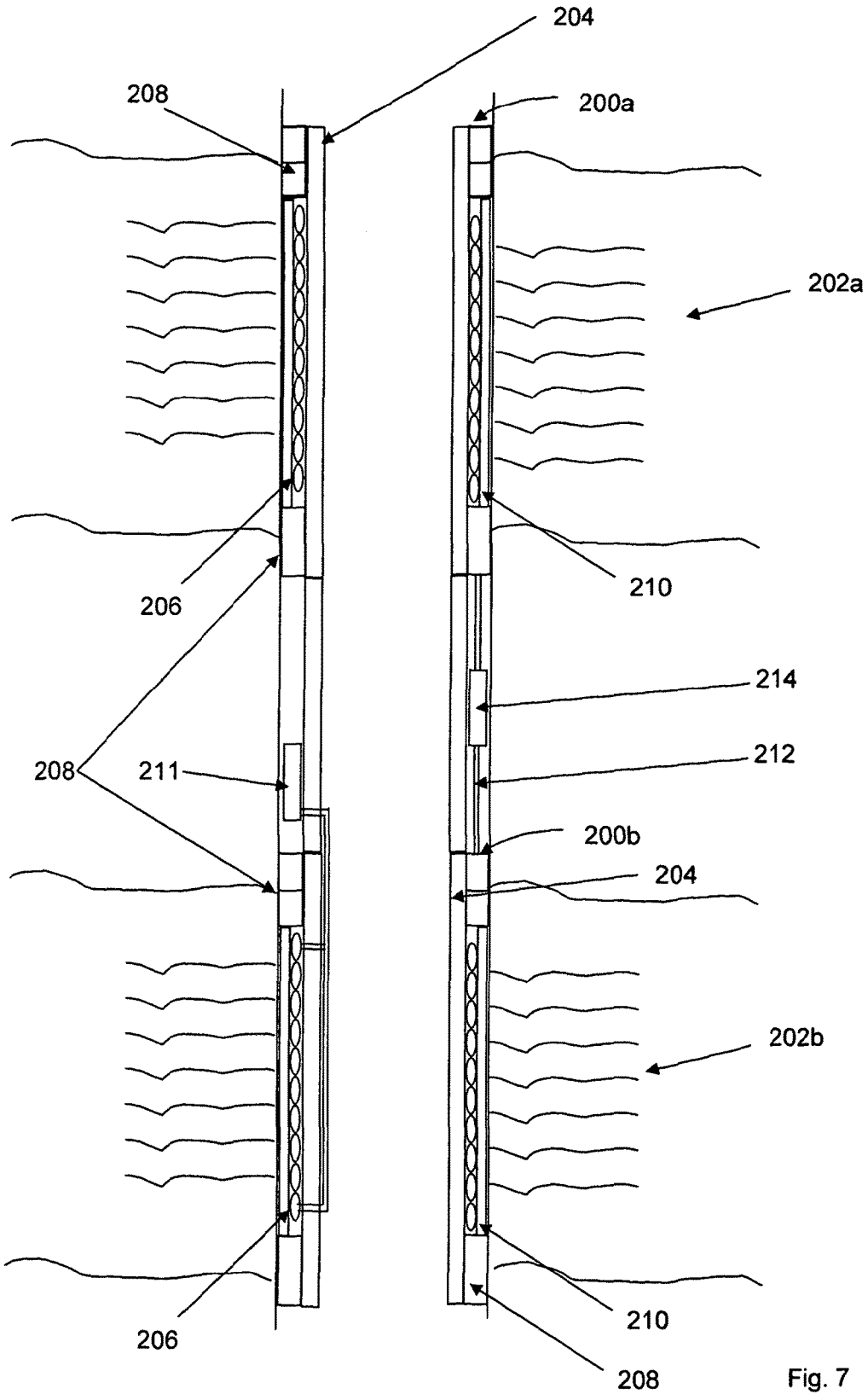
FIG. 7 is a sectional view of apparatus of an embodiment of the present invention in a bore intersecting two formations.

Reference is now made to FIG. 7 of the drawings, which illustrates apparatus 200*a,b* in accordance with an embodiment of the present invention, an upper apparatus 200*a* straddling a low pressure formation 202*a* and a lower apparatus 200*b* straddling a high pressure formation 202*b*.

Both apparatus 200 include a base pipe 204 carrying a plurality of pressure deformable chambers 206. Packer elements 208 are provided at the ends of each apparatus 200 and a sand control element 210 is wrapped around each collection of chambers 206.

The ends of the chambers 206 are formed of more readily deformable material than the centre sections such that, when the chambers 206 are inflated, the ends of the chambers 206 tend to deform and extend before the centre sections. Thus, the packer elements 208 are extended and engage the bore wall before the sand control element-carrying centre sections are extended.

As with the other embodiments, the tubing string comprising the apparatus is made up with the chambers 206 in an initial flattened configuration. Once the string has been run into the bore and the apparatus 200*a,b* positioned across the formations 202*a,b*, the lower apparatus 200*b* is actuated or inflated by activating a string-mounted fluid pressure source 211. The activation may comprise signaling a sensor on the source 211, which signal may comprise a pressure signature or the like. The pressure source 211 contains two liquid components which are mixed as the components are expelled into the chambers 206*b*. As noted above, the ends of the chambers 206*b* expand first, followed by the remainder of the chambers. The pressure source 211 is configured to supply the liquid at a predetermined pressure to create a predetermined force on the wall of the bore.

The mixed liquid components react and cure within the chambers 206*b* to form a solid filling which prevents deflation of the chambers thus maintaining the inflated chamber form, and also maintaining the force on the bore wall.

The high pressure formation 202*b* is now isolated and flow of fluid from the formation 202*b* into the base pipe 204 may now be controlled through operation of ICDs provided on the apparatus 200*b*.

The high pressure fluid from the formation 202*b* is also in communication with a control line 212 which extends from the lower apparatus 200*a* to the upper apparatus 200*b* via a remotely activated valve 214. Thus, once the lower apparatus 200*b* has been actuated and the formation 202*b* isolated, the valve 214 may be opened and the high pressure fluid from the formation 202*b* used to actuate the upper apparatus 200*a*.

Figure 8:
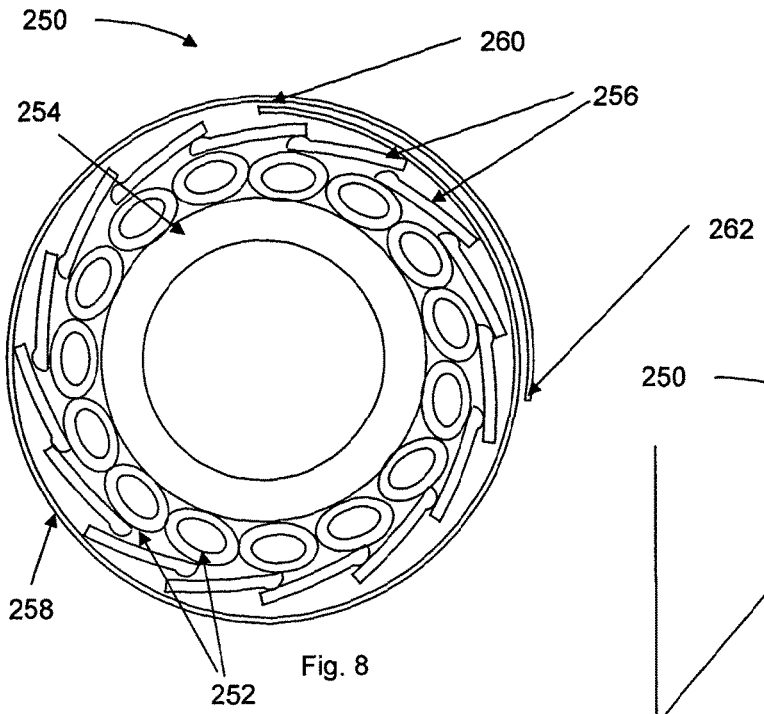
FIG. 8 is a sectional view of a sand control apparatus in accordance with an embodiment of the invention.
Figure 10:
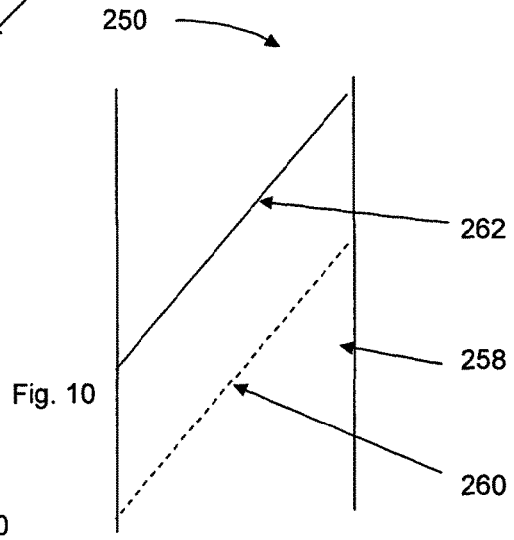
FIG. 10 is an external view of the apparatus of FIG. 8.
Figure 9:
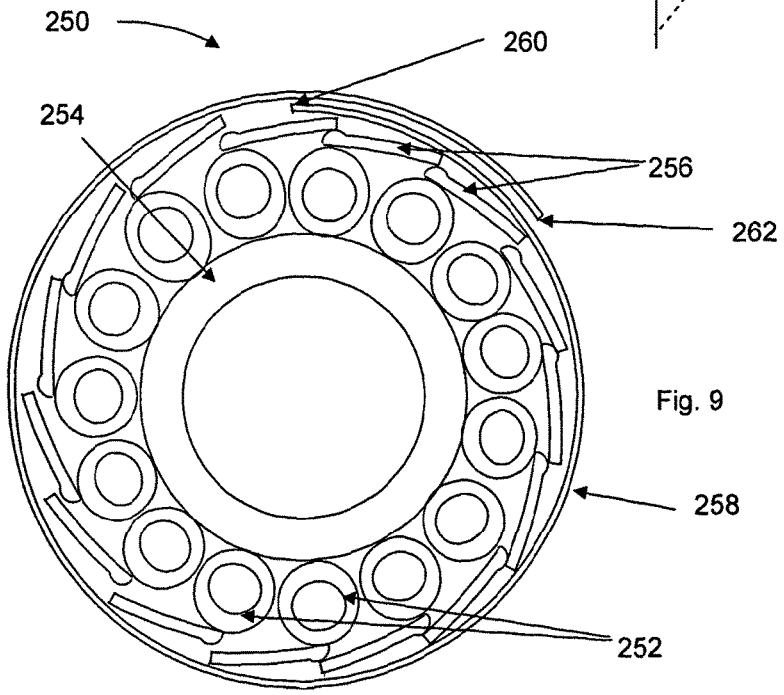
FIG. 9 is a view of the apparatus of FIG. 8 in an extended configuration.

Reference is now made to FIGS. 8, 9 and 10 of the drawings, which are schematic illustrations of details of an apparatus 250 in accordance with an embodiment of the present invention. FIG. 8 shows the apparatus 250 in an initial configuration, in which a series of axially extending fluid pressure deformable chambers 252 are mounted about a base pipe 254. The chambers 252 are initially in a flattened deflated configuration. Mounted on each chambers 252 is an axially extending apertured bridging member 256, one edge of the bridging member being fixed to a respective chamber 252 and the other edge of the member 256 extending to rest on an adjacent chamber 252. A single-piece sand control element 258 is wrapped around the chambers 252 and the bridging members 256, the edges of the element 260, 262 overlapping. As may be seen from FIG. 10, overlapping edges extend helically along the apparatus 250, and are thus inclined to the main axis of the apparatus.

The sand control element 258 features a coating of hardened material, for example a diamond coating. Such a coating resists erosion of the element 258 and also facilitates relative sliding movement between the overlapping edges 206, 262 and other elements of the apparatus 250, and minimises the risk of damage to the edges 260,262 during the expansion process. In other embodiments the whole element 258 could be formed of a relatively hard material.

On filling the chambers 252 with high pressure fluid the chambers 252 deform and radially extend such that the diameter defined by the apparatus 250 increases, as shown in FIG. 9. In particular, if the apparatus 250 is located in a bore, the sand control element 258 will be pushed into contact with the surrounding bore wall. The sand control element 258 floats on the bridging members 256, and as the chambers inflate the overlap at the edges of the element decreases. Also, the bridging members 256 slide over one another, collectively maintaining a generally cylindrical form and bridging the gaps that form between the inflated chambers 252. The bridging members 256 thus ensure that the sand control element 258 is fully supported around the circumference of the apparatus 250 and that the element 258 applies a substantially constant force to the bore wall.

Figure 11:
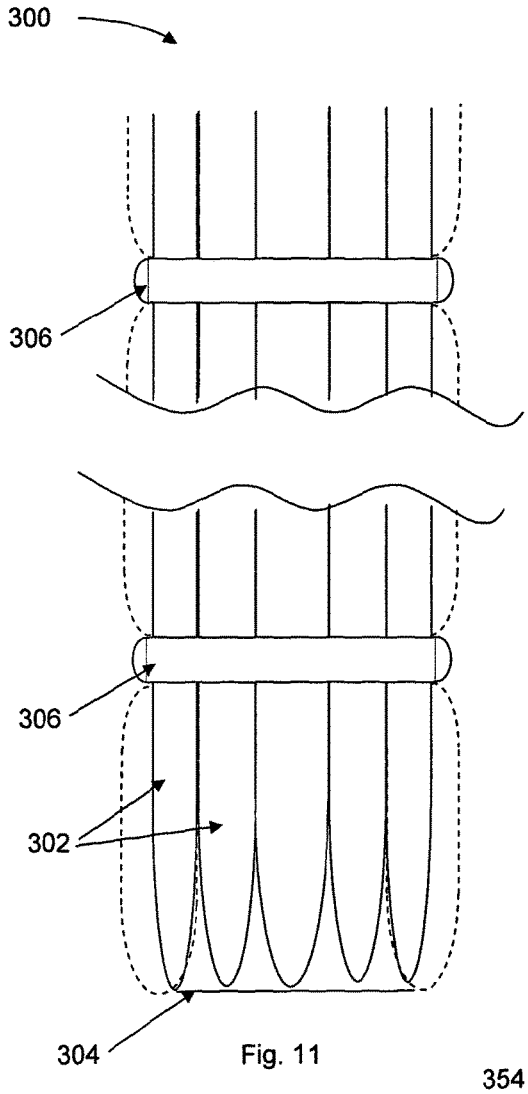
FIG. 11 is a view of an apparatus of an embodiment of the present invention including retaining rings.

Reference is now made to FIG. 11, 11A an 11B of the drawings, which illustrates an apparatus 300 in accordance with an embodiment of the present invention. In this embodiment pressure deformable chambers 302 are retained on a base pipe 304 formed by a single pipe joint by retaining rings 306 provided adjacent the pipe ends.

Figure 11A:
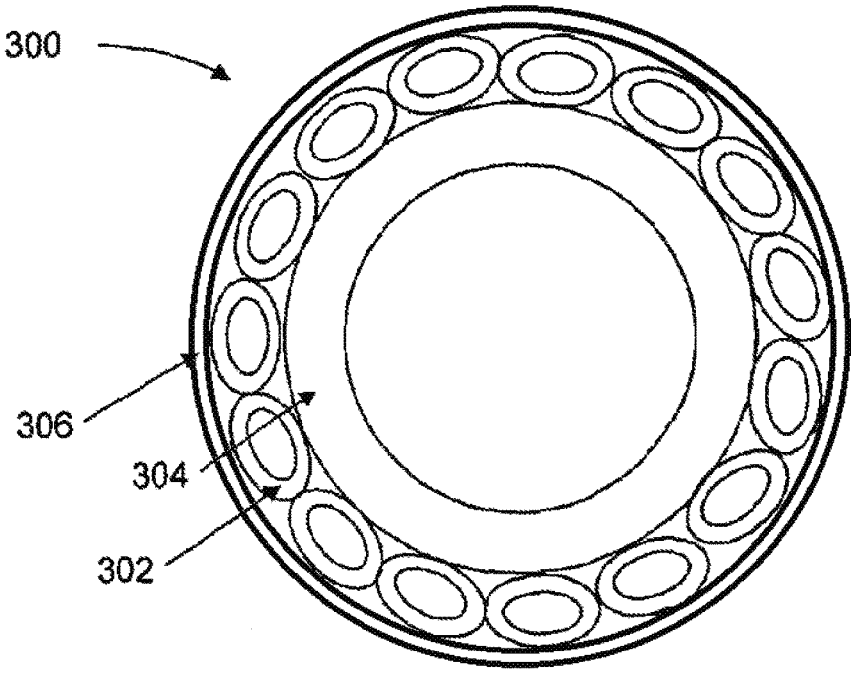
FIG. 11A is a schematic end view of the apparatus of FIG. 11 illustrating the retaining rings located over deflated chambers.
Figure 11B:
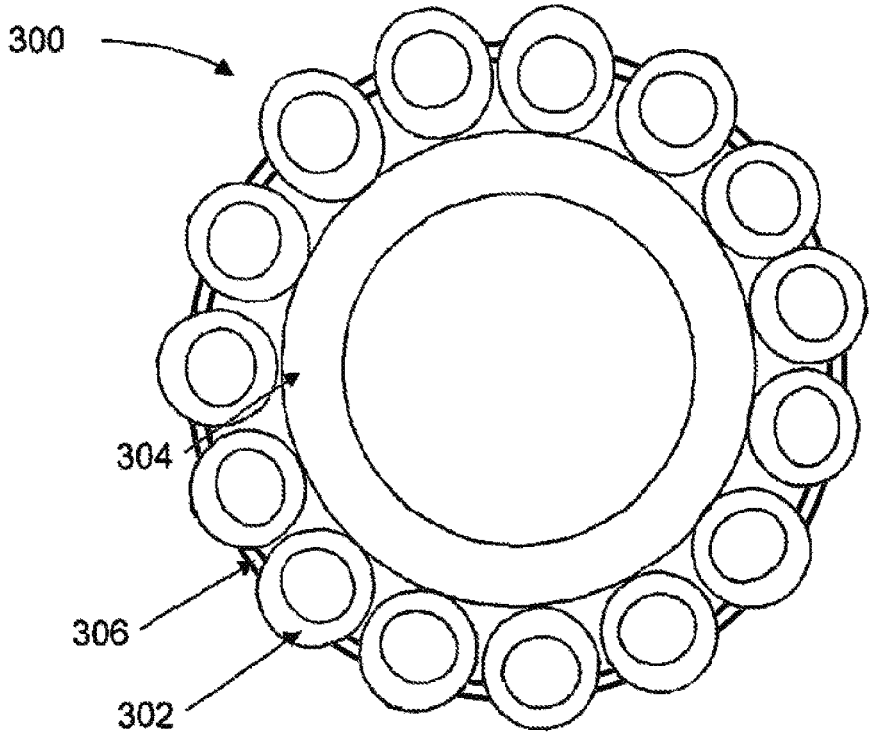
FIG. 11B is a schematic end view of the apparatus of FIG. 11 illustrating the retaining rings located over inflated chambers.

The rings 306 may be located over the flattened deflated chambers 302, (FIG. 11A) and radially separated from the base pipe 304 by the chambers 302, and when the chambers 302 are inflated and deformed (FIG.11B) the rings 306 retain their form and constrain the portions of the chamber 302 beneath the rings 306. The portions of the chambers 302 adjacent the rings 306 will extend radially beyond the rings 306, as illustrated in broken outline in FIG. 11, and thus serve to retain the rings 306 axially while the rings 306 retain the chambers 302 radially.

The chambers 302 are formed of tubes in which the tube ends have been welded closed by a rounded weld. The use of a tapered or rounded weld reduces the build-up of stresses at the end of the chamber during inflation of the chamber 302. The rings 306 are longitudinally spaced from the tube ends of the chambers 302.

Figure 12:
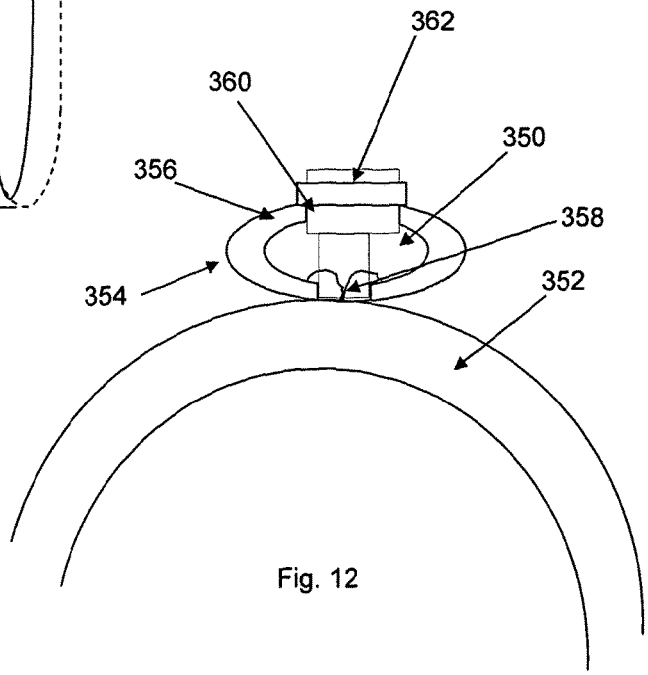
FIG. 12 is a view of a chamber-fixing feature of an embodiment of the present invention.

Reference is now made to FIG. 12 of the drawings, which illustrates a method of fixing a pressure deformable chamber 350 to a base pipe 352. The chamber 350 is formed by hollow steel member 354 with a wall 356 defining first and second apertures 358, 360. An operator uses the second aperture 360 to gain access to the first aperture 358 and weld the member 354 to the base pipe 352 at the first aperture 358. The welding operation creates a fluid-tight seal at the first aperture 358. The second aperture is then closed with a patch 362, to seal the hollow member 354.

Although the above embodiments are described with reference to fluid injection or production operations, the apparatus of the present invention may also be utilized during a drilling operation, for example an apparatus in accordance with an embodiment of the invention may be run into a bore and activated to stabilize an unstable or swelling formation, to reduce or prevent fluid losses into a low pressure formation, or to stem the flow of fluid into a bore from a high pressure formation. The apparatus may be mounted on the drill string or may be run in separately of the drill string. The apparatus may be removed from the bore once the situation has been stabilized or other measures have been put in place. The removal of the apparatus from the bore may be facilitated by deflating the pressure deformable chambers/elements and permitting ambient pressure in the bore to flatten the chambers, or by utilizing elastic-walled chambers. Alternatively, the apparatus may remain in the bore. In other embodiments, parts of the apparatus may remain in the bore while other parts of the apparatus are retrieved. For example, the apparatus may carry an expandable or extendable fluid impermeable element, and inflation of the fluid deformable chambers may locate the element against the bore wall. The fluid impermeable element may be configured to retain the larger diameter when the chambers are deflated, or the element may be held in place by differential pressure. The element may thus serve to prevent or minimise losses into a low pressure formation or may be utilized to minimise problems due to differential sticking.

The invention claimed is:

1. A downhole apparatus comprising a base pipe, a plurality of axially extending pressure deformable members mounted around the base pipe and at least one circumferential retaining ring axially spaced from ends of the deformable members and located externally of the members radially spaced from the base pipe and the at least one circumferential retaining ring always maintained disconnected from the base pipe by the deformable members and the each one of the plurality of deformable members is always non-concentric with the base pipe.

2. The apparatus of claim 1, wherein the deformable members are initially located on the base pipe in a deflated configuration and the retaining ring located over the deflated members.

3. The apparatus of claim 1, wherein a plurality of rings are provided.

4. The apparatus of claim 3, wherein the at least one circumferential retaining ring includes respective rings provided at each end of a pipe joint.

5. A downhole method comprising:

locating a plurality deformable members on a base pipe in a deflated configuration, wherein the each one of the plurality of deformable members is always non-concentric with the base pipe;

locating at least one retaining ring over the deflated deformable members such that the at least one retaining ring is radially spaced from the base pipe by the deformable members and axially spaced from axial ends of the deformable members to thereby retain the deformable members radially; and inflating the deformable members to extend radially beyond the at least one retaining ring to thereby retain the at least one ring axially along the deformable members; and maintaining the at least one retaining ring always disconnected from the base pipe by the deformable members.

6. The method of claim 5, wherein inflating the deformable members includes inflating two portions of the deformable members adjacent the at least one ring on opposite axial sides of the at least on retaining ring.

7. The method of claim 5, wherein locating at least one retaining ring includes providing respective retaining rings over the deformable members at each end of the base pipe.

* * * * *